US008863353B2

(12) United States Patent
Smith

(10) Patent No.: US 8,863,353 B2
(45) Date of Patent: Oct. 21, 2014

(54) VACUUM CLEANER HAVING DIRT CUP ASSEMBLY WITH INTERNAL AIR GUIDE

(71) Applicant: Panasonic Corporation of North America, Secaucus, NY (US)

(72) Inventor: Shawn M. Smith, Lancaster, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 180 days.

(21) Appl. No.: 13/678,731

(22) Filed: Nov. 16, 2012

(65) Prior Publication Data

US 2014/0137362 A1 May 22, 2014

(51) Int. Cl.
*A47L 9/00* (2006.01)
*A47L 9/16* (2006.01)

(52) U.S. Cl.
CPC ..... *A47L 9/1633* (2013.01); *A47L 9/1641* (2013.01)
USPC ..... 15/347; 15/353

(58) Field of Classification Search
CPC ..... A47L 5/28; A47L 7/0038; A47L 7/0028; A47L 7/0042; A47L 9/127; A47L 9/20; A47L 9/1683; A47L 9/1691; A47L 9/1666
USPC ..... 15/350, 352, 353, 347; 55/337, 345, 55/420, 482, DIG. 3
See application file for complete search history.

(56) References Cited

U.S. PATENT DOCUMENTS

| | | | | |
|---|---|---|---|---|
| 7,497,899 | B2 * | 3/2009 | Han et al. | 96/95 |
| 7,547,336 | B2 * | 6/2009 | Fester et al. | 55/337 |
| 7,966,692 | B2 | 6/2011 | Kim | |
| 8,409,335 | B2 * | 4/2013 | Dyson et al. | 96/55 |
| 8,533,903 | B2 * | 9/2013 | Muhlenkamp et al. | 15/352 |
| 2006/0254226 | A1 | 11/2006 | Jeon | |
| 2007/0079584 | A1 | 4/2007 | Kim et al. | |
| 2007/0079586 | A1 | 4/2007 | Kim | |

* cited by examiner

*Primary Examiner* — Dung Van Nguyen
(74) *Attorney, Agent, or Firm* — King & Schickli, PLLC

(57) ABSTRACT

A floor cleaning apparatus includes a body having a suction inlet and an exhaust outlet. A dirt cup assembly is carried on the body. The dirt cup assembly includes a primary cyclone, a plurality of secondary cyclones and an airflow path between the primary cyclone and the plurality of secondary cyclones. A suction generator is carried on the body. The suction generator moves an airstream through the suction inlet, the airflow path of the dirt cup assembly and the suction outlet. The airflow path is characterized by a primary air guide including an airflow surface that provides for laminar airflow between the secondary cyclones.

18 Claims, 8 Drawing Sheets

VACUUM CLEANER HAVING DIRT CUP ASSEMBLY WITH INTERNAL AIR GUIDE

TECHNICAL FIELD

This document relates generally to the floor care equipment field and, more particularly, to a floor cleaning apparatus including a dirt cup assembly equipped with an internal air guide system for providing more efficient airflow.

BACKGROUND

Upright and canister vacuum cleaners that utilize dirt cup assemblies to remove and collect dirt and debris entrained in an airstream are well known in the art. Many dirt cup assemblies take advantage of cyclonic airflow to provide enhanced cleaning. Many of those dirt cup assemblies M incorporate a relatively large or primary cyclone upstream from a plurality of relatively small secondary cyclones P (see FIG. 8). Such secondary cyclones P are commonly radially arrayed around a central axis of the dirt cup assembly M and are provided in parallel downstream from the primary cyclone.

Such a dirt cup assembly M provides very good cleaning action. It should be appreciated, however, compact design is a major consideration when producing upright and canister vacuum cleaners. Accordingly, a relatively large number of components are incorporated into a relatively confined space in the dirt cup assembly M. The routing of an airstream around and through these components is complicated and there are many potential corners and pockets that create dead air space, undesired air turbulence, and airflow inefficiency. Such a pocket Q is illustrated in FIG. 8 between secondary cyclones P near the top of the dirt cup assembly M (note action arrows R representing turbulent air stream). The present invention relates to a dirt cup assembly incorporating an internal air guide system that minimizes such air turbulence to enhance airflow and overall vacuum cleaner operating efficiency.

SUMMARY

In accordance with the purposes noted above, a floor cleaning apparatus is provided comprising a body including a suction inlet and an exhaust outlet. A dirt cup assembly is carried on the body. The dirt cup assembly includes a primary cyclone, a plurality of secondary cyclones and an airflow path between the primary cyclone and the plurality of secondary cyclones. In addition the floor cleaning apparatus includes a suction generator carried on the body. The suction generator moves an airstream through the suction inlet, the air flow path of the dirt cup assembly and the exhaust outlet.

The airflow path is characterized by a primary air guide including an arcuate airflow surface extending from a first end to a second end. The first end includes a first opening having a first surface area ($A_1$). The second end includes a second opening having a second surface area ($A_2$) where ($A_1>A_2$). Further the first end includes an edge having a series of scallops.

In one embodiment each scallop of the series of scallops extends at least partially around one secondary cyclone of the plurality of secondary cyclones. Further each edge includes a point between any two adjacent scallops of the series of scallops. Each point projects between any two adjacent secondary cyclones of the plurality of secondary cyclones. In addition the secondary cyclones are radially arrayed around the air guide. In operation the airstream flows serially from the primary cyclone through the first opening and the second opening of the air guide to the plurality of secondary cyclones.

In one possible embodiment the first surface area ($A_1$) and the second surface area ($A_2$) have a surface area ratio of between about 1.5 to 1 to about 7.5 to 1. In one particularly useful embodiment the first surface area ($A_1$) and the second surface area ($A_2$) have a surface area of about 1.87 to 1. In another particularly useful embodiment the plurality of secondary cyclones includes eight secondary cyclones and the series of scallops includes eight scallops. Each scallop of the series of scallops includes a radius of curvature of about 17.5 mm. Further each scallop of the series scallops includes a depth of about 6 mm. In addition the primary air guide has a length from the first end to the second end of about 19 mm.

The floor cleaning apparatus may comprise, for example, an upright vacuum cleaner or a canister vacuum cleaner wherein the body thereof includes a nozzle assembly and a canister assembly. The nozzle assembly includes the suction inlet and the canister assembly includes the exhaust outlet. In the upright vacuum cleaner the nozzle assembly and canister assembly are pivotally connected together.

In the following description there shown and describe several different vacuum cleaner embodiments. It should be realized, the vacuum cleaner is capable of still other different embodiments and its several details are capable of modification in various obvious aspects. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the vacuum cleaner and together with the description serve to explain certain principles of the vacuum cleaner. In the drawings.

Reference will now be made in detail to the present preferred embodiment of the vacuum cleaner illustrated in the accompanying drawings.

DETAILED DESCRIPTION

Figure 1:
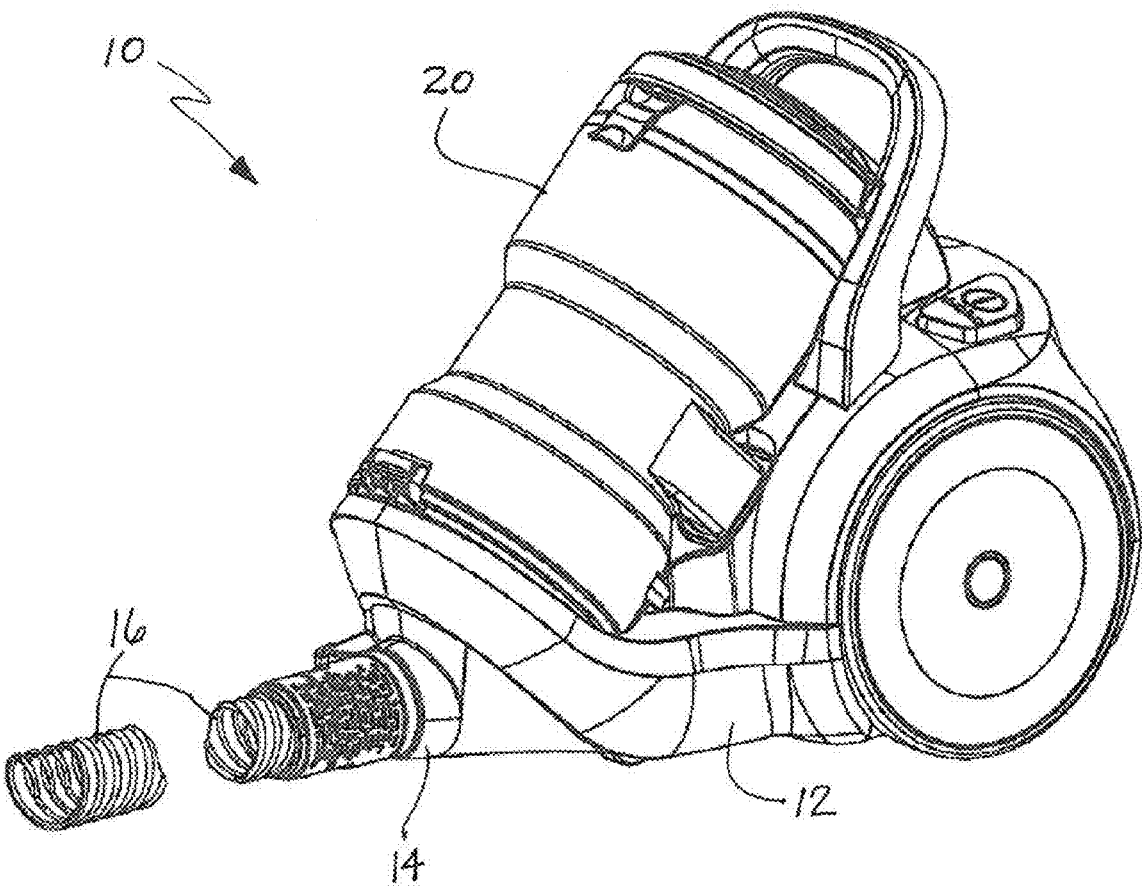
FIG. 1 is a front perspective view of a canister vacuum cleaner including a dirt cup assembly with an internal air guide.
Figure 2:
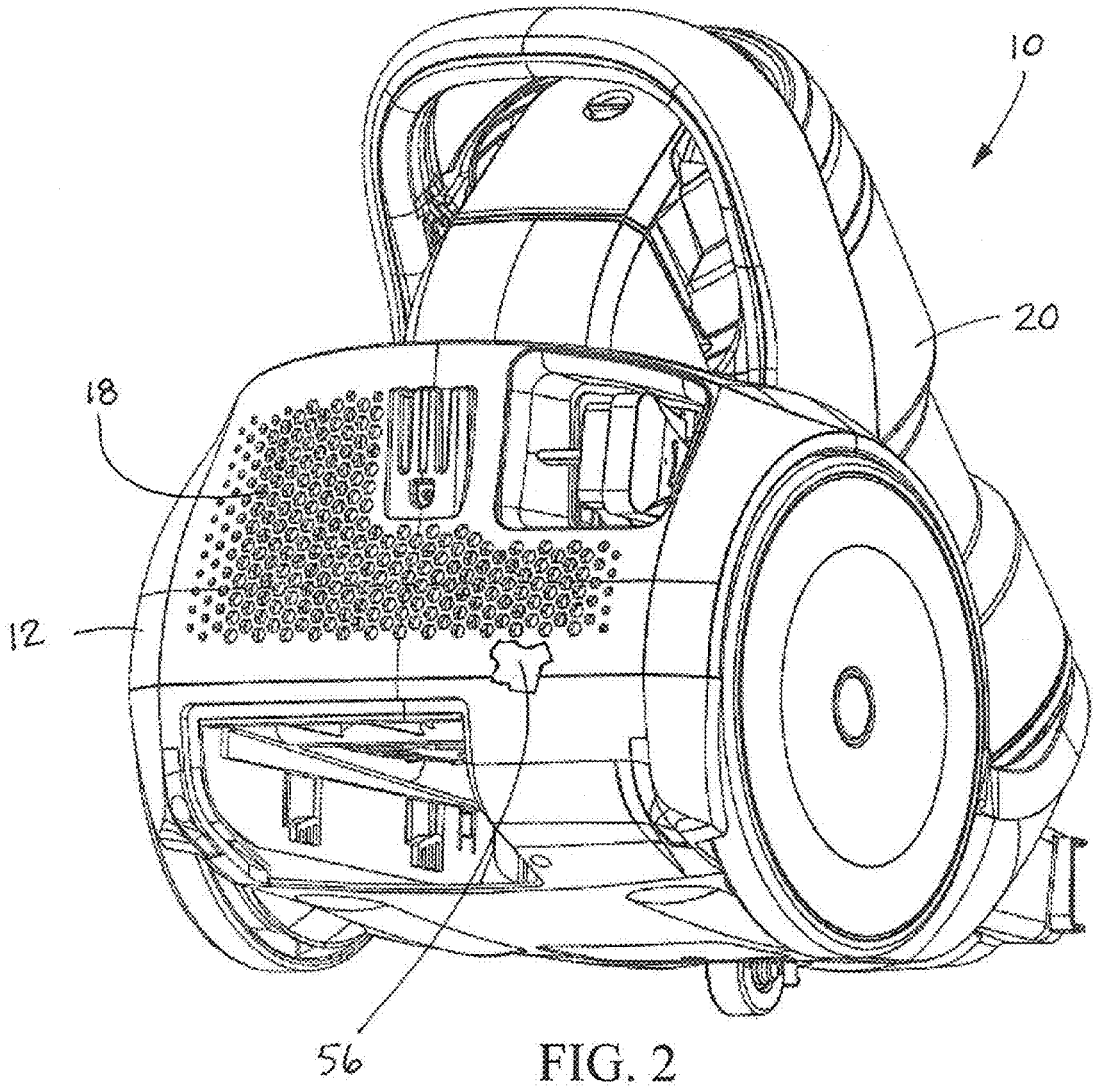
FIG. 2 is a rear perspective view of the canister vacuum cleaner of FIG. 1 partially cut-away to show the suction generator.

Reference is made to FIGS. 1 and 2 generally illustrating the vacuum cleaner 10. The vacuum cleaner 10 includes a body 12 having a suction inlet 14 connected to a flexible hose 16 and an exhaust outlet 18. As is known in the art, the flexible hose 16 may be connected to a power nozzle assembly or other cleaning tool (not shown).

A dirt collection vessel 20, in the form of a dirt cup assembly, is carried on the body 12. As best illustrated in FIG. 4, the dirt cup assembly 20 comprises a primary cyclone 22 upstream from a plurality of radially arrayed secondary cyclones 24.

More specifically, the dirt cup assembly 20 includes an outer sidewall 26 and a bottom wall 28 defining a dirt collection chamber 30. The bottom wall 28 is connected to the sidewall 26 by means of a hinge 32. The bottom wall 28 may be swung open on the hinge 32 by releasing the latch 34 in order to empty dirt and debris from the dirt collection chamber 30 when desired.

The dirt cup assembly 20 further includes a shroud 36 including a series of airflow apertures 38. The shroud 36 is concentrically received within the sidewall 26. The shroud 36 is also concentrically received around a substantially cylindrical element 40 that defines a dirt collection chamber 42 for relatively fine dirt and debris received from the secondary cyclones 24.

Figure 3:
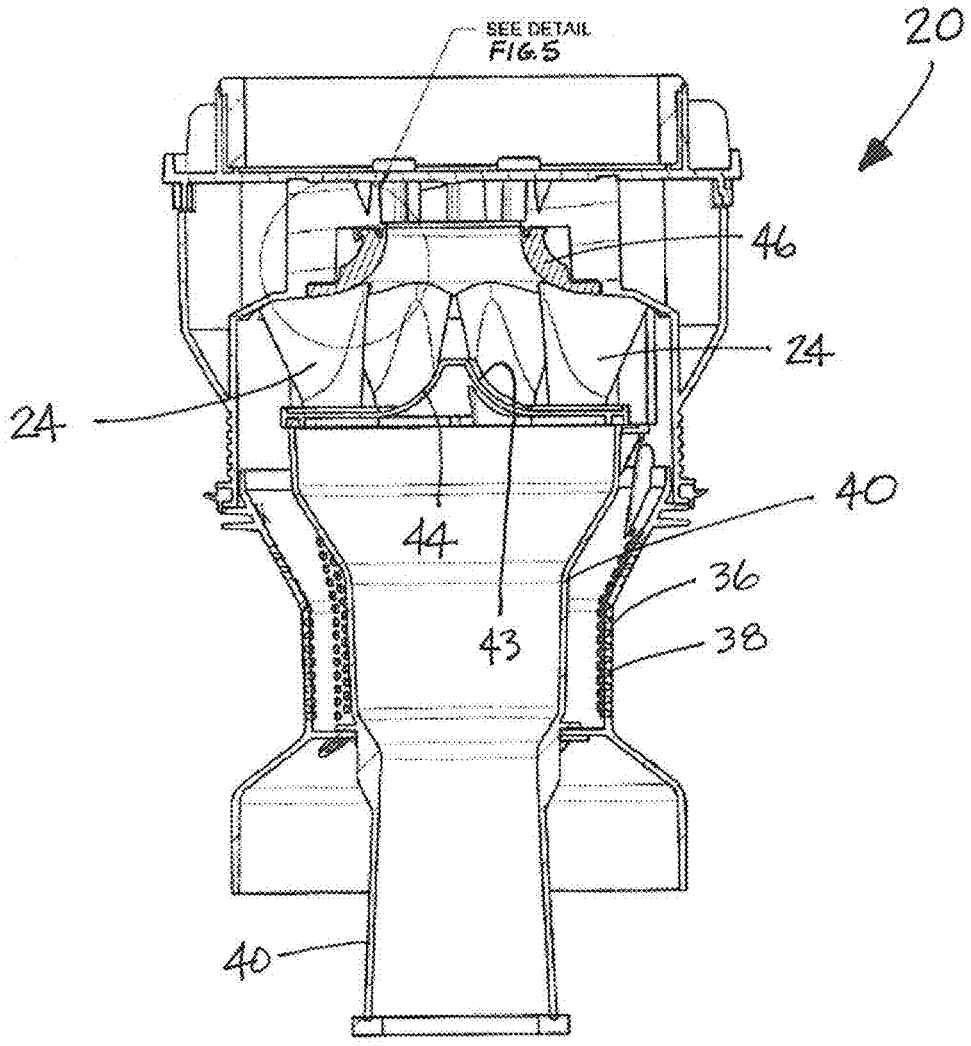
FIG. 3 is a cross-sectional view of the internal components of the dirt cup assembly showing the position of the air guide between the secondary cyclones of the dirt cup assembly.
Figure 4:
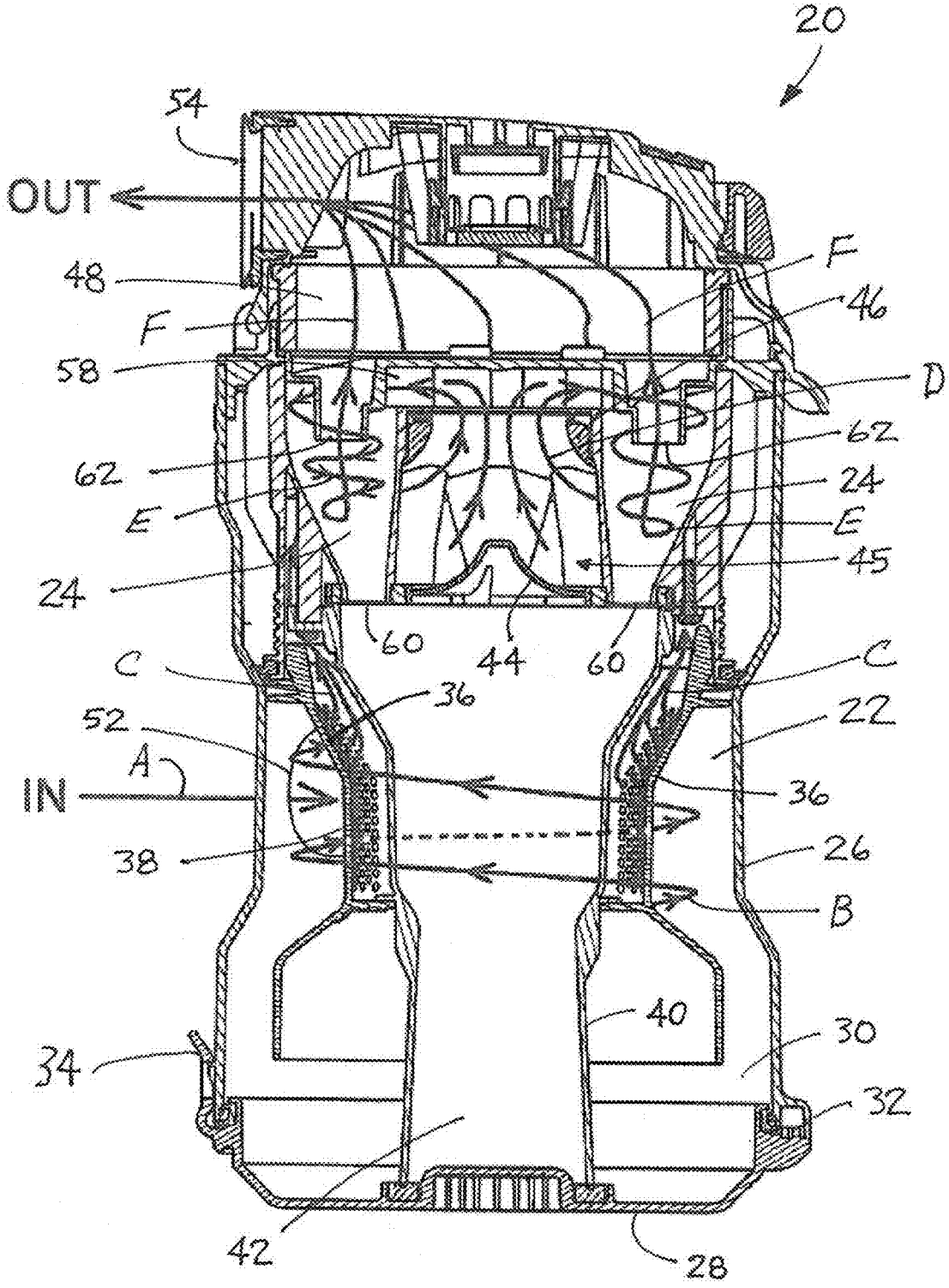
FIG. 4 is a cross-section view similar to FIG. 3 but showing the entire dirt cup assembly and the airflow through the dirt cup assembly by means of action arrows.
Figure 5:
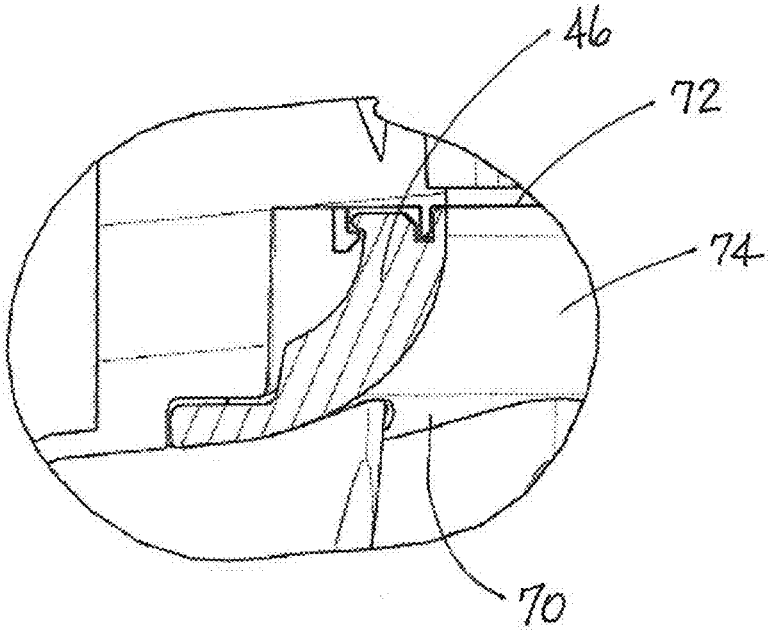
FIG. 5 is a detailed cross-sectional view taken from FIG. 3.
Figure 6:
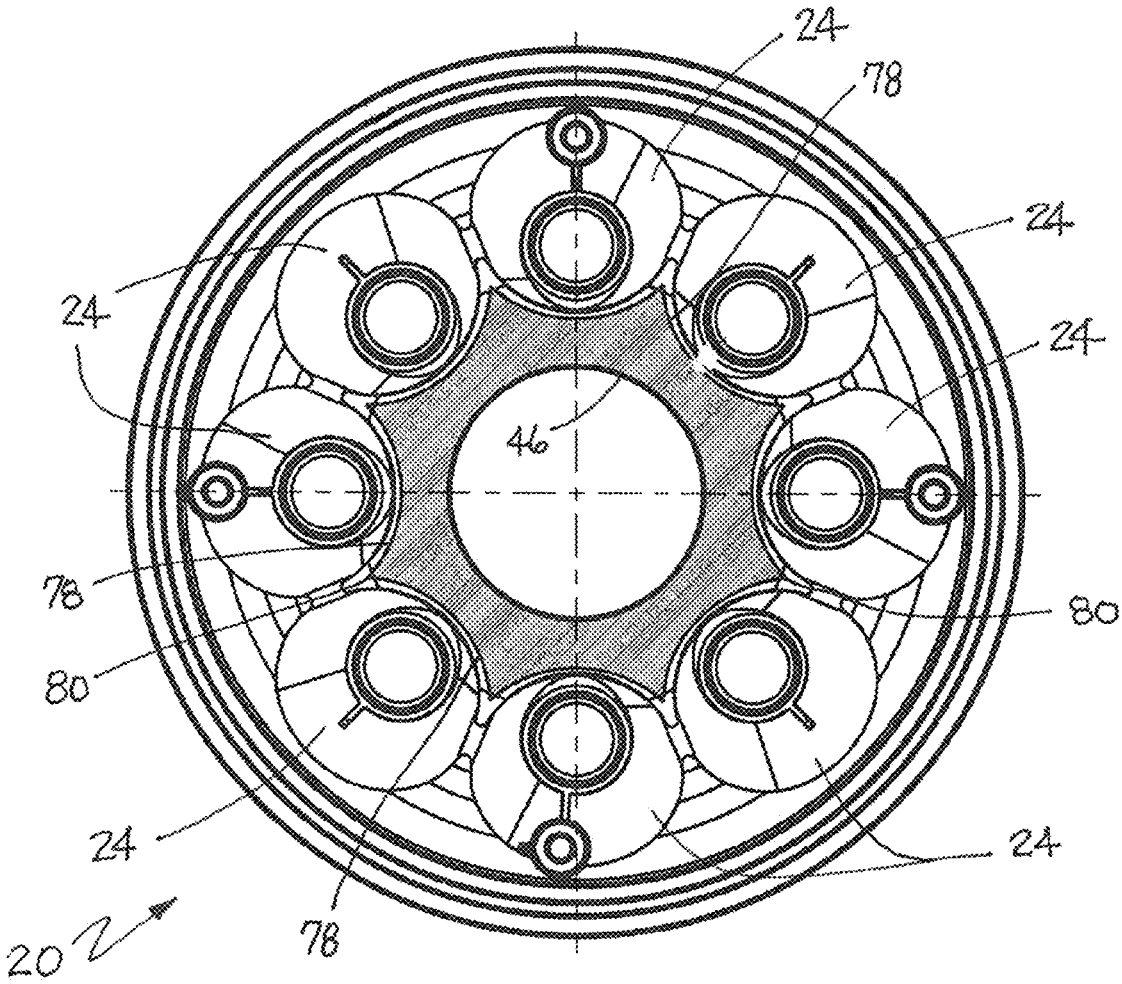
FIG. 6 is a detailed cross-sectional view showing the primary air guide positioned inside the radially arrayed secondary cyclones.
Figure 7:
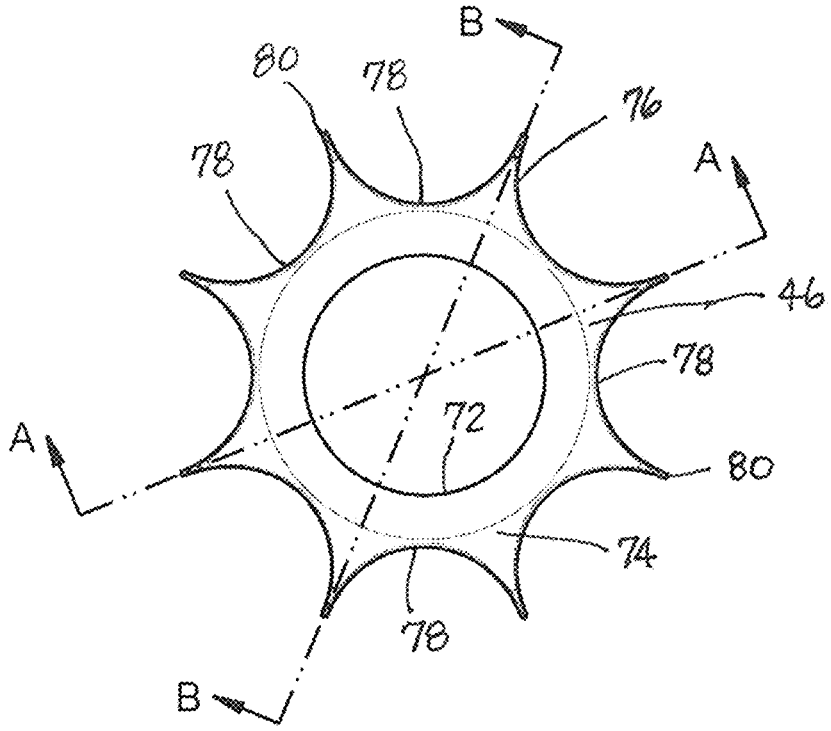
FIG. 7 is a detailed top plan view of the primary air guide.
Figure 7A:
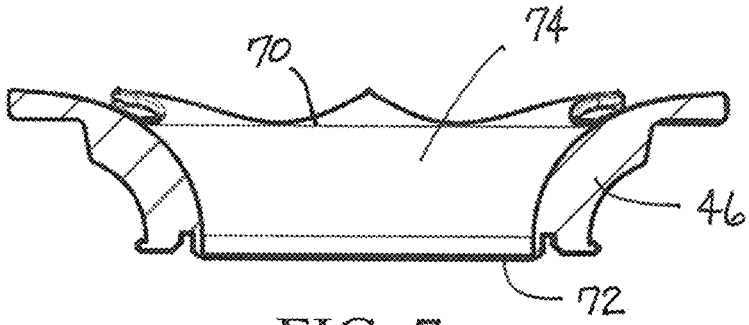
FIGS. 7*a* and 7*b* are respective cross-sectional views of the primary air guide along lines A-A and B-B of FIG. 7.
Figure 7B:
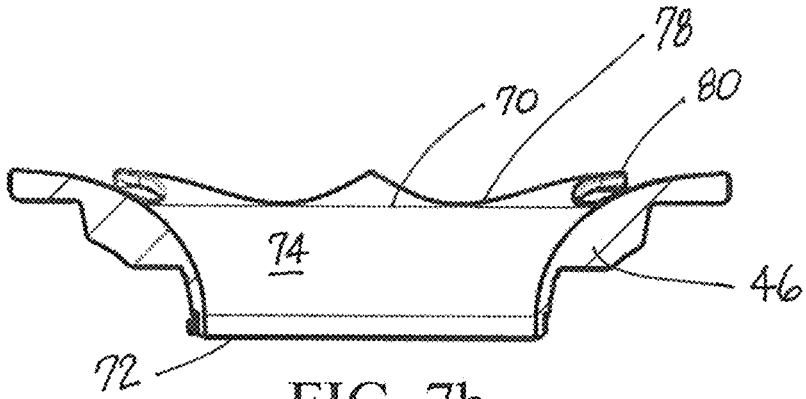

As should be appreciated from reviewing FIGS. 3, 4 and 6, the secondary cyclones 24 are positioned above the primary cyclone 22 and radially arrayed around an internal air guide system including a first or preliminary air guide 44 and a second or primary air guide 46 positioned along the central axis of the dirt collection assembly 20. A filter 48 is provided in the top of the dirt collection vessel 20. As should be appreciated, the preliminary air guide 44 includes an arcuate flow surface 43 that is directed toward and directs air flow toward the first end or opening 70 of the primary air guide 46. Thus, the two air guides 44, 46 work in concert to provide smooth and efficient air flow.

As best illustrated in FIG. 4, a tangentially directed inlet 52 is provided in the outer sidewall 26 and an exhaust port 54 is provided in the top 50. A suction generator, such as a fan and motor assembly 56, is carried in the body 12. The suction generator 56 draws an airstream entrained with dirt and debris through the hose 16 and suction inlet 14 to the tangentially directed inlet 52 of the dirt cup assembly 20. The airstream enters the dirt collection chamber 30 through the tangentially directed inlet 52 (note action arrow A) and the airstream then swirls in cyclonic fashion around the shroud 36 in the dirt collection chamber 30 (note action arrow B). Centrifugal force functions to cause relatively large or coarse particles of dirt and debris to move outwardly against the sidewall 26 where they slow and drop toward the bottom wall 28 of the dirt collection chamber 30. The airstream, now free of the relatively large and coarse particles of dirt and debris, is then drawn through the airflow apertures 38 in the shroud 36 (note action arrow C). The airstream then travels upwardly between the shroud 36 and the element 40 toward the secondary cyclones 24. The airstream then passes along an airflow path, generally designated by reference numeral 45, between the secondary cyclones 24 and is directed by the curved surface 43 of the first air guide 44 toward the second air guide 46 that smoothly and efficiently directs the airstream into the inlets 58 of the secondary cyclones 24 (note action arrow D).

The inlets 58 tangentially direct the airstream along the smooth interior walls of the secondary cyclones 24 where the airstream swirls rapidly in a cyclonic fashion so that fine dust particles remaining in the airstream flow along the outer walls and drop downwardly into the secondary dirt collection chamber 42 through the secondary cyclone debris outlets 60 (note the action arrows E). The airstream, now free of substantially all dirt and debris passes through the clean air outlets 62 of the secondary cyclones 24 into the filter 48 and then passes through the exhaust outlet 54 thereby leaving the dirt cup assembly 20 (note action arrows F). The airstream is then drawn through a conduit into the suction generator compartment holding the suction generator 56. The airstream passes over the motor of the suction generator 56 to provide cooling before being exhausted from the vacuum cleaner via the exhaust outlet 18 after passing through a final filter (not shown).

The second or primary air guide 46 is shown in detail in FIGS. 6, 7, 7*a* and 7*b*. The air guide 46 includes a first end 70, a second end 72 and a smooth and continuous airflow surface 74 that extends between the first and second ends. The first end 70 includes a first opening having a first surface area ($A_1$) and the second end 72 includes a second opening having a second surface area ($A_2$) wherein ($A_1 > A_2$). Typically the first surface area ($A_1$) and the second surface area ($A_2$) have a surface area ratio of between about 1.5 to 1 to about 7.5 to 1. In one particularly useful embodiment the first surface area ($A_1$) and the second surface area ($A_2$) have a surface area ratio of between about 1.87 to 1. In some useful embodiments the first surface area ($A_1$) is between about 2,000 $mm^2$ and about 5,400 $mm^2$. In some useful embodiments the second surface area ($A_2$) is between about 700 $mm^2$ and about 1,200 $mm^2$.

As further illustrated in FIGS. 3, 5, 6, 7, 7*a* and 7*b*, the first end 70 of the air guide 46 includes an edge 76 having a series of scallops 78. Each of the series of scallops 78 extends at least partially around one secondary cyclone 24 (i.e. between 35 and 55 degrees). The edge 76 also includes a point 80 between any two adjacent scallops of the series of scallops 78. Each point 80 projects between any two adjacent secondary cyclones 24 of the plurality of secondary cyclones which are radially arrayed around the air guide 46. As should be appreciated, the scalloped edge 76 abuts and engages the outer walls of each secondary cyclone 24 so as to direct airflow toward the secondary cyclone inlets 58 and away from dead air space corners and closed-end pockets between the secondary cyclones.

In the illustrated embodiment there are eight secondary cyclones 24 and eight scallops 78. Each scallop 78 includes a radius of curvature of about 17.5 mm and has a depth of about 6 mm. In one possible embodiment the air guide 46 has a length from the first end 70 to the second end 72 of about 19 mm.

Figure 8:
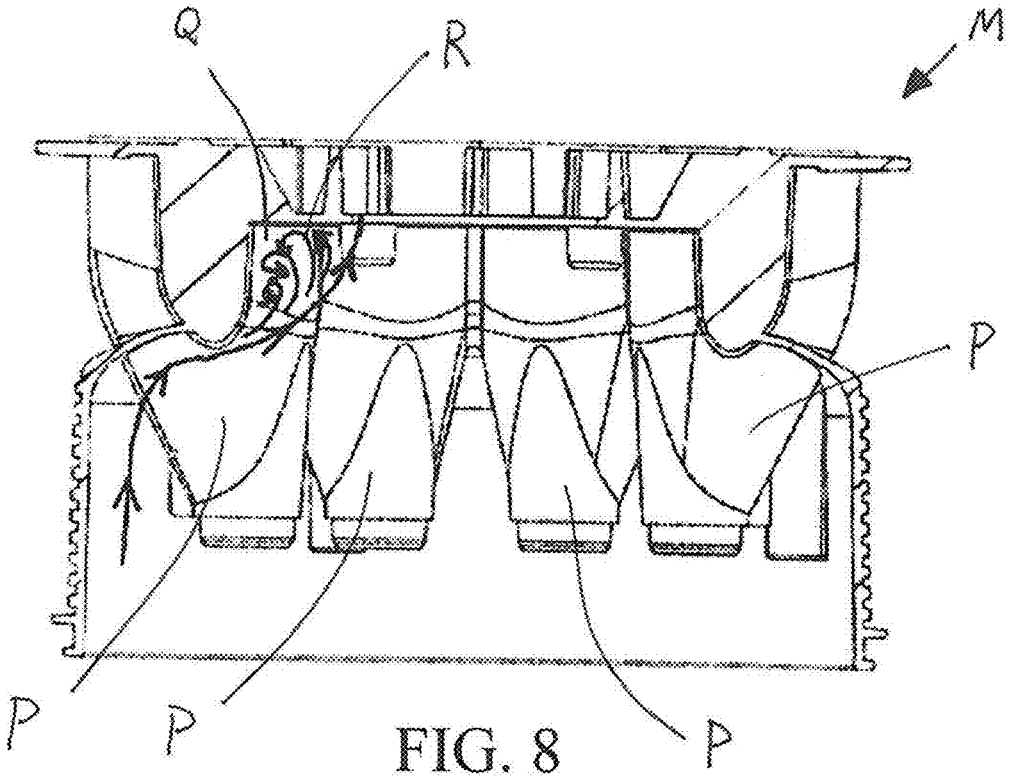
FIG. 8 is a detailed cross-sectional view of a prior art dirt cup assembly including a closed corner or pocket between secondary cyclones that creates turbulence in the airstream flowing through the dirt cup assembly.

As illustrated in drawing FIG. 4, the airflow surface 74 of the air guide 46 functions to provide smooth laminar airflow between the secondary cyclones 24 so as to enhance overall air flow efficiency of the vacuum cleaner 10. In contrast, in prior art designs without an air guide 46 there are closed corners or pockets Q between the secondary cyclones P which cause air turbulence that interrupts clean airflow and reduces cleaning efficiency (see FIG. 8). Thus, it should be appreciated that the air guide 46 provides a substantial benefit and represents an advancement of the vacuum cleaner manufacturing art.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A floor cleaning apparatus, comprising:

a body including a suction inlet and an exhaust outlet;

a dirt cup assembly carried on said body, said dirt cup assembly including a primary cyclone, a plurality of secondary cyclones and an airflow path between said primary cyclone and said plurality of secondary cyclones; and a suction generator carried on said body, said suction generator moving an airstream through said suction inlet, said airflow path of said dirt cup assembly and said exhaust outlet;

said airflow path being characterized by a primary air guide including an airflow surface extending from a first end to a second end, said first end including a first opening having a first surface area ($A_1$) and said second end including a second opening having a second surface area ($A_2$) where ($A_1 > A_2$), said first end further including an edge having a series of scallops.

2. The apparatus of claim 1 wherein each scallop of said series of scallops extends at least partially around one secondary cyclone of said plurality of secondary cyclones.

3. The apparatus of claim 2, wherein said edge includes a point between any two adjacent scallops of said series of scallops.

4. The apparatus of claim 3, wherein each point projects between any two adjacent secondary cyclones of said plurality of secondary cyclones.

5. The apparatus of claim 4, wherein said plurality of cyclones are radially arrayed around said air guide.

6. The apparatus of claim 5, wherein said airstream flows serially from said primary cyclone through said first opening and said second opening of said air guide to said plurality of secondary cyclones.

7. The apparatus of claim 1, wherein said first surface area ($A_1$) and said second surface area ($A_2$) have a surface area ratio of between about 1.5 to 1 to about 7.5 to 1.

8. The apparatus of claim 1, wherein said first surface area ($A_1$) and said second surface area ($A_2$) have a surface area ratio of about 1.87 to 1.

9. The apparatus of claim 1, wherein said first surface area ($A_1$) is between about 2,000 $mm^2$ and about 5,400 $mm^2$.

10. The apparatus of claim 1, wherein said second surface area ($A_2$) is between about 700 $mm^2$ and about 1,200 $mm^2$.

11. The apparatus of claim 10, wherein said plurality of secondary cyclones includes eight secondary cyclones and said series of scallops includes eight scallops.

12. The apparatus of claim 11, wherein each scallop of said series of scallops includes a radius of curvature of about 17.5 mm.

13. The apparatus of claim 12, wherein each scallop of said series of scallops includes a depth of about 6 mm.

14. The apparatus of claim 13, wherein said air guide has a length from said first end to said second end of about 19 mm.

15. The apparatus of claim 1, wherein said body includes a nozzle assembly and a canister assembly.

16. The apparatus of claim 15, wherein said nozzle assembly includes said suction inlet and said canister assembly includes said exhaust outlet.

17. The apparatus of claim 16, wherein said nozzle assembly and canister assembly are pivotally connected together so as to form an upright vacuum cleaner.

18. The apparatus of claim 1 including a preliminary air guide having a flow surface directed toward said first end of said primary air guide.

* * * * *